US006739850B2

(12) United States Patent
Kawasaki et al.

(10) Patent No.: US 6,739,850 B2
(45) Date of Patent: May 25, 2004

(54) MOTOR-TYPE FUEL PUMP FOR VEHICLE

(75) Inventors: Hiroaki Kawasaki, Ibaraki-pref. (JP); Akihiro Kimura, Ibaraki-pref. (JP); Yoshio Ebihara, Kariya (JP)

(73) Assignees: Kyosan Denki Co., Ltd., Sashima (JP); Denso Corporation, Kariya (JP)

( * ) Notice: Subject to any disclaimer, the term of this patent is extended or adjusted under 35 U.S.C. 154(b) by 0 days.

(21) Appl. No.: 10/274,392

(22) Filed: Oct. 21, 2002

(65) Prior Publication Data

US 2003/0108445 A1 Jun. 12, 2003

(30) Foreign Application Priority Data

Oct. 25, 2001 (JP) ..... 2001-328425
Aug. 9, 2002 (JP) ..... 2002-232195

(51) Int. Cl.[7] ..... F04C 2/00

(52) U.S. Cl. ..... 418/171; 418/166; 418/180; 418/189

(58) Field of Search ..... 418/171, 166, 418/180, 189

(56) References Cited

U.S. PATENT DOCUMENTS 3,834,842 A * 9/1974 Dorff et al. ..... 418/171
5,263,818 A 11/1993 Ito et al.
5,364,246 A * 11/1994 Frank et al. ..... 418/171
5,586,858 A 12/1996 Tuckey
5,680,700 A 10/1997 Tuckey

FOREIGN PATENT DOCUMENTS

| | | | | |
|---|---|---|---|---|
| DE | 4237249 A1 | * | 5/1993 | ..... F02M/37/20 |
| JP | 63131878 A | * | 6/1988 | ..... F04C/02/10 |
| JP | 02075783 A | * | 3/1990 | ..... F04C/02/10 |
| JP | A 10-331777 | | 12/1998 | |
| WO | WO 9601950 A1 | * | 1/1996 | ..... F04C/02/16 |

* cited by examiner

*Primary Examiner*—Thomas Denion
*Assistant Examiner*—Theresa Trieu
(74) *Attorney, Agent, or Firm*—Oliff & Berridge, PLC

(57) ABSTRACT

At a boundary area between a high-pressure portion in which a discharge port of a fuel pump is disposed and a low-pressure portion in which an intake port is disposed, a pressure relief groove extending along the boundary area is formed so as to be communicated with the outside of the pump by pressure relief hole. Alternatively, a slit is formed communicated with the outside. Accordingly, a fuel at a high-pressure area portion can be drained with reliability. Further, by communicating the above pressure relief groove with a positioning pin insertion port, a single hole can serve both as a positioning pin insertion hole and a pressure relief hole.

4 Claims, 12 Drawing Sheets

RELETED ART

MOTOR-TYPE FUEL PUMP FOR VEHICLE

The disclosure of Japanese Patent Application Nos. 2001-328425 filed on Oct. 25, and 2002-232195 filed on Aug. 9, 2002 including the specification, drawings and abstract are incorporated herein by reference in their entirety.

BACKGROUND OF THE INVENTION

1. Field of the Invention

The invention relates to a motor-driven type fuel pump for a vehicle to be accommodated in a fuel tank for a vehicle, and more particularly to a motor-type fuel pump for a vehicle to reliably prevent entry of a fuel compressed by a compression stroke of a pump into an intake side as vapor, and further to allow a single hole to serve both as positioning pin for executing positioning when assembling a housing and a cover and as a pressure relief hole for releasing pressure in a pump chamber.

2. Description of Related Art

Recently, as a fuel pump for supplying fuel to a vehicle engine, an in-tank type motor-driven fuel pump which is installed in a fuel tank is used. Among them, a fuel pump suspending from a flange member secured to an opening of an upper wall of the fuel tank is widely used. Further, a unit-type fuel pump incorporating a filter or the like thereinto has also been used.

In such fuel pumps, a pump body portion is structured by combining a housing 42 formed with a pump chamber 41 therein and a cover 43 abutting against a lower surface of the housing 42 so as to cover the pump chamber 41, as shown for example in a sectional view of the pump portion in FIG. 9. The pump chamber 41 is provided, as a pump member, with an inner rotor 44 of a trochoid-gear type or the like. The inner rotor 44 is rotated by a rotation axis 46 of a motor 45, and a fuel in the fuel tank is sucked through an intake port 47 formed on the cover 43 and discharged through a discharge hole 48 into a motor chamber 50. Next, the fuel passing through the motor chamber 50 is pressurized, and supplied through an exhaust hole, not shown, on the upper portion of the pump body to a fuel injection system and the like.

In a fuel pump like this, particularly when the fuel temperature is increased, there are some cases where the fuel pressurized inside the pump generates vapor from the inside of the pump and deteriorates pump performance. Therefore, as shown in FIG. 9B, a pressure relief hole 54 communicated with the outside of the pump is formed piercing the cover 43 at a position between the intake port 47 and the discharge hole 48 at an end portion of a place at which a high-pressure area of the pump is formed.

FIGS. 10A and 10B show this state in more detail. Particularly, as shown in FIG. 10B, which is a sectional view taken along line XB—XB portion in FIG. 10A, an internal tooth gear-like pump chamber outer peripheral surface is formed on an inner peripheral surface 56 of the pump chamber portion in an outer rotor 60 rotatably disposed in the housing 42. Inside the internal tooth gear-like pump chamber outer peripheral surface, rotatably provided is an external tooth gear-like inner rotor 44, capable of meshing with the pump chamber outer peripheral surface in a manner of the trochoid-gear type, and having a small diameter and a smaller number of teeth than the aforementioned internal teeth. Then, the inner rotor 44 is rotated by the rotation axis 46 driven by the motor 45 as above, and pump action is carried out.

At this time, in accordance with rotation of the inner rotor 44 in a direction shown in arrow R in the figure, the fuel sucked through the intake port 47 is sucked via an intake groove 57 formed on the upper surface of the cover 43 into a chamber portion at an intake stroke side in the pump chamber. After that, the chamber at the intake stroke side is closed and the fuel is compressed, the chamber is communicated with a discharge groove 58 formed at a discharge port 48 side, and the fuel is discharged through the discharge port 48 to the inside of the motor body.

When the inner rotor 44 is further rotated, the external teeth of the inner rotor 44 mesh with the internal teeth formed on the inner surface of the outer rotor 60, thereby forming a high-pressure closed chamber portion P in the figure. After that, when the high-pressure closed chamber is communicated with the intake groove 57 caused by the rotation of the inner rotor 44, a high-pressure fuel enters a low-pressure fuel through the intake hole 47. Since the pressure is released, liquid inside carries out vacuum boiling and vaporizes. Therefore, vapor contaminates the fuel at the intake side in the pump chamber, causing a vapor lock state in which the fuel is unable to be compressed sufficiently. This may sometimes deteriorate pump performance remarkably.

As a countermeasure, for example, as shown in FIGS. 9A, 9B, 10A and 10B, the pressure relief hole 54 is formed at a position where a high-pressure area of the pump is formed. The pressure relief hole 54, for example, as shown in FIG. 10B, is provided on the cover 43 between a front edge portion of the intake groove 57 and a rear edge portion of the discharge groove so as to pierce the cover toward below the pump. Owing to this, the high-pressure fuel is introduced from a portion of the highest pressure shown as point P in the figure to the pressure relief hole 54, through a narrow gap between opposite wall surfaces of the cover 43 and the housing 42. Then, the fuel is released from the pressure relief hole 54 into the fuel tank.

A problem of generation of vapor lock due to entry of the high-pressure fuel at the discharge side into the intake side in the fuel pump as above occurs not only in a trochoid-gear type positive-displacement fuel pump as shown in the figure but also in other positive-displacement fuel pumps. Further, as well as in positive-displacement fuel pumps, similar problems occur in various non-positive-displacement fuel pumps of wesco type or the like.

In the meantime, when assembling the housing 42 and the cover 43 as above, in order to easily perform a precise relative positioning between the intake port 47 portion formed on the cover 43 and the discharge hole 48 portion formed on the housing 42 or the like, a positioning pin 52 is inserted into a positioning pin insertion hole 59 at the housing 42 side and fixed in advance so as to protrude toward the cover 43 side, which is then inserted into the positioning pin insertion hole 59 formed in the cover 43. Alternatively, the positioning pin 52 is inserted into the positioning pin insertion hole 59 of the cover 43 and fixed so as to protrude toward the housing 42 side, which is then inserted into the positioning pin insertion hole 59 formed on the housing 42.

Accordingly, when assembling this fuel pump, for example, in a case where the positioning pin 52 is fixed at the housing 42 side in advance, a tip of the positioning pin 52 is fitted into the pin insertion hole 53 of the cover 43 so as to combine the both in a state where a pump member 44 is disposed in the pump chamber 41 of the housing 42. The combined one is incorporated into a tip of the rotation axis 46 of the motor 45, and the tip and the rotation axis are bonded by an external casing 55, so as to provide an integrated fuel pump unit as a whole. Note that, an example of the positioning pin 52 to be used includes a C-type pin in cross section or the like.

In a fuel pump like this, in order to prevent generation of vapor lock caused by entry of the fuel across the boundary area from the high-pressure discharge side to the low-pressure intake side in the pump, the pressure relief hole 54 for communicating the boundary area with the outside of the pump was provided. However, as the pressure relief hole is provided at one point of the area, namely in a point-like manner, pressure relief was not always carried out sufficiently. Thus, effects of preventing generation of vapor lock is not sufficient.

Further, in a fuel pump as above, it was necessary to form the positioning pin insertion hole 53 in the cover 43 through which the positioning pin 52 passes, and further the pressure relief hole 54 as above. Therefore, since it was necessary to form these holes separately in the cover 43 or the like of the pump, man-hours are increased and the pump becomes expensive.

SUMMARY OF THE INVENTION

Therefore, it is a first object of the invention to prevent with reliability generation of vapor lock caused by entry of high-pressure fuel at a discharge side of a pump chamber into an intake side thereof. It is a second object of the invention to eliminate the necessity of forming a positioning pin press fitting hole and a pressure relief hole separately, allow a single hole to serve as both holes. Further, it is a third object of the invention to achieve the first and second objects by using the same means.

In order to achieve the first object, a motor-type fuel pump for a vehicle according to a first aspect of the invention is provided with a pressure relief portion extended along a boundary area portion between a high-pressure portion and a low-pressure portion, which be communicated with a pressure chamber so as to reduce a pressure in the pressure chamber Note that, in a case of a trochoid-gear type pump as shown in the figure, the "high-pressure portion" of the pump refers to a high-pressure portion in which a sucked fuel is compressed due to reduced volume of a pump chamber in accordance with rotation of an inner rotor and an outer rotor, and "low-pressure portion" refers to a low-pressure portion in which the fuel is sucked and secured due to increased volume of the pump chamber in accordance with rotation of the inner rotor and the outer rotor. Note that, a problem like this occurs not only in a trochoid-gear type pump like this, but also in other positive-displacement fuel pumps. Further, it also occurs in various non-positive-displacement fuel pumps of a wesco type or the like as well as postivie-displacement fuel pumps. In those pumps, there are also a "high-pressure portion" which is a compression side, and a "low-pressure portion" which is an intake side. The problem like this can be solved by using the aforementioned means for solving the problem.

Further, a fuel pump according to the invention may have a structure in which, at a boundary area portion between the high-pressure portion and the low-pressure portion of the pump, a groove or a slit is formed extending along the boundary area portion, so that the groove or the slit communicates the chamber with the outside of the fuel pump.

Further, in order to achieve the second object, a motor-type fuel pump for a vehicle according to a second aspect of the invention, is provided with a pressure relief hole which both positions a housing that accommodates the pump therein and a cover formed with a fuel intake hole with a positioning pin and releases pressure in a pump chamber. The motor-type fuel pump is structured such that the positioning pin is inserted into the aforementioned pressure relief hole and a pressure relief passage can be secured in the aforementioned pressure relief hole when inserting the positioning pin.

Further, in order to achieve the aforementioned first and second objects by the same method, a fuel pump according to the second aspect of the present invention may be structured such that the aforementioned pressure relief hole may be communicated with the boundary area portion between the high-pressure portion and the low-pressure portion by means of a opening, such as a pressure relief groove, extending along the boundary area portion.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 1A is a sectional view taken along line IA—IA in FIG. 1B, and FIG. 1B is a sectional view taken along line IB—IB in FIG. 1A.

FIG. 3A is a sectional view taken along line IIIA—IIIA in FIG. 3B, and FIG. 3B is a perspective view of the cover portion.

FIG. 4A is a sectional view taken along line IVA—IVA in FIG. 4B, and FIG. 4B is a bottom view of the cover portion.

FIG. 5A is a sectional view taken along line VA—VA in FIG. 5B, and FIG. 5B is a sectional view taken along line VB—VB in FIG. 5A according to the same embodiment.

FIG. 6A is a sectional view, and FIG. 6B is a plan view.

FIG. 7A is a sectional view and FIG. 7B is a plan view.

FIG. 9A is a sectional view taken along line IXA—IXA in FIG. 9B, and FIG. 9B is a perspective view of the cover portion.

FIG. 10A is a sectional view taken along line XA—XA in FIG. 10B, and FIG. 10B is a sectional view taken along line XB—XB in FIG. 10A.

DETAILED DESCRIPTION OF THE PREFERRED EMBODIMENTS

Figure 1A:
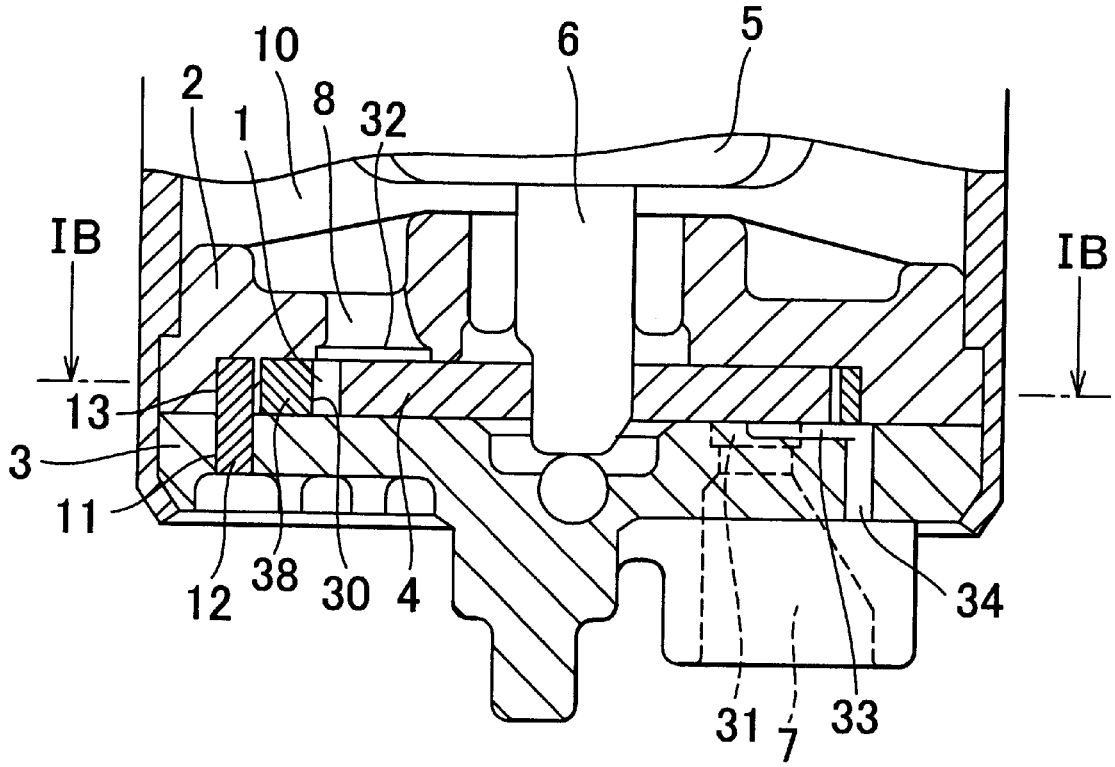
FIGS. 1A and 1B show an embodiment of a motor-type fuel pump for a vehicle according to the invention.
Figure 1B:
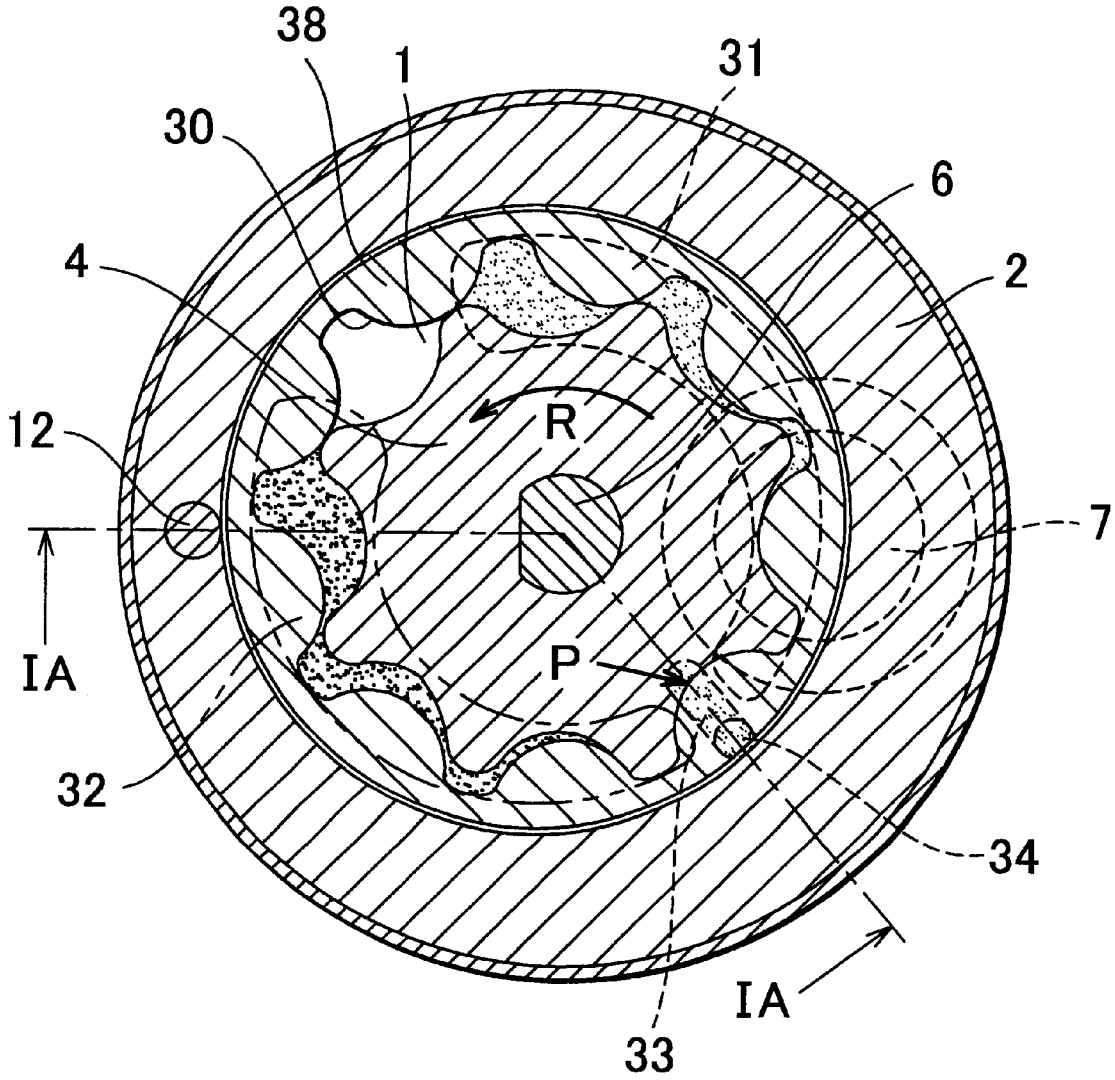
Figure 2:
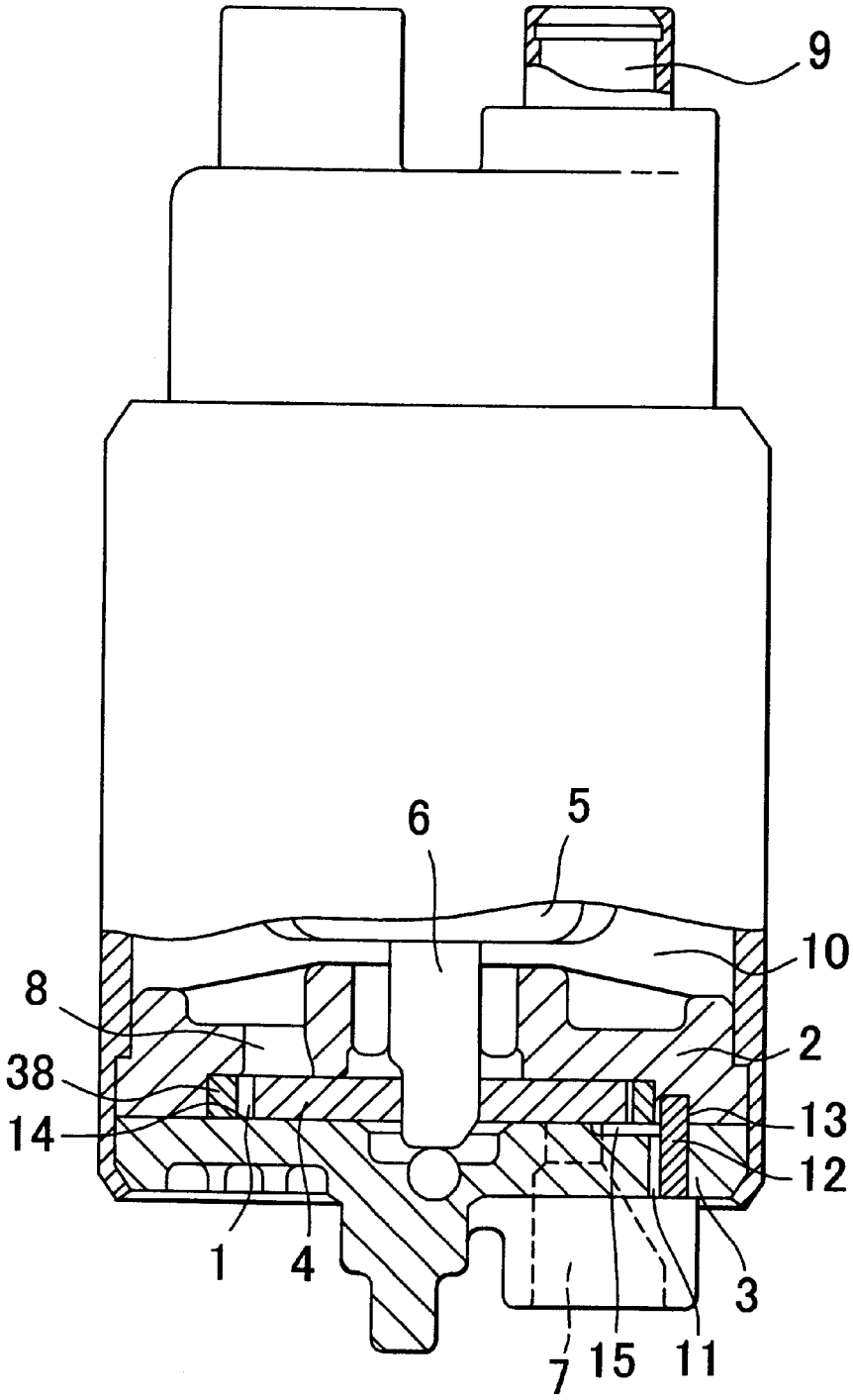
FIG. 2 is a side view of another embodiment of a motor-type fuel pump for a vehicle according to the invention, with a sectional view of a main portion thereof.

Embodiments of the invention will be explained with reference to the drawings. FIGS. 1A and 1B show an embodiment of a motor-type fuel pump for a vehicle according to the invention. FIG. 1A is a sectional view taken along line IA—IA in FIG. 1B, and FIG. 1B is a sectional view taken along line IB—IB in FIG. 1A. FIG. 2 is a side view with a sectional view of a main portion of another embodiment of a motor-type fuel pump for a vehicle according to the invention.

Figure 9A:
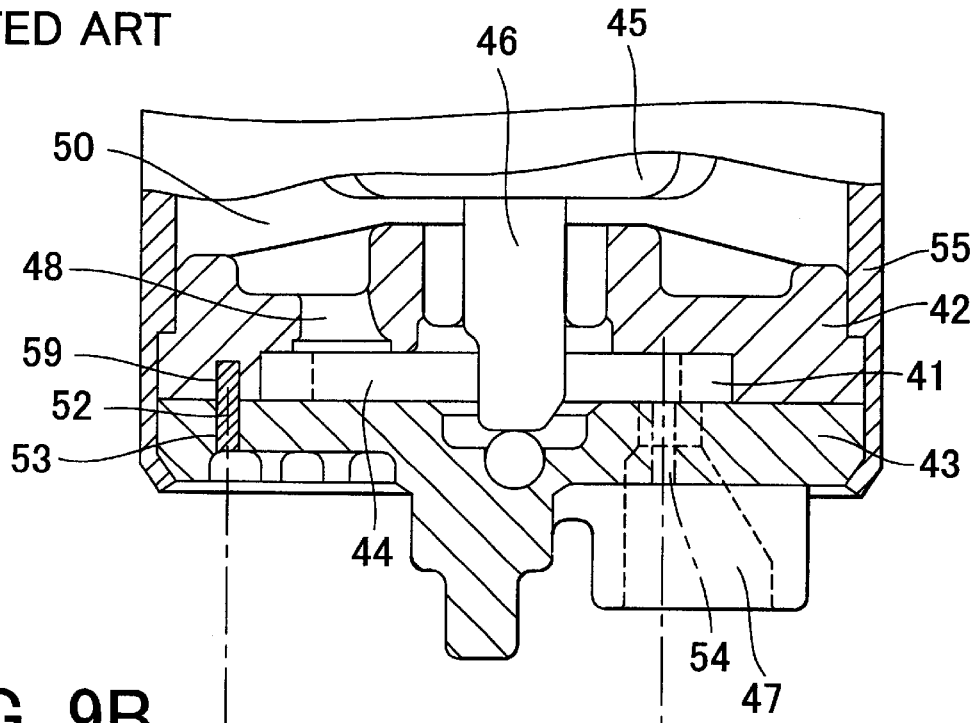
FIG. 9A RELATED ART
FIGS. 9A and 9B show a related art.
Figure 9B:
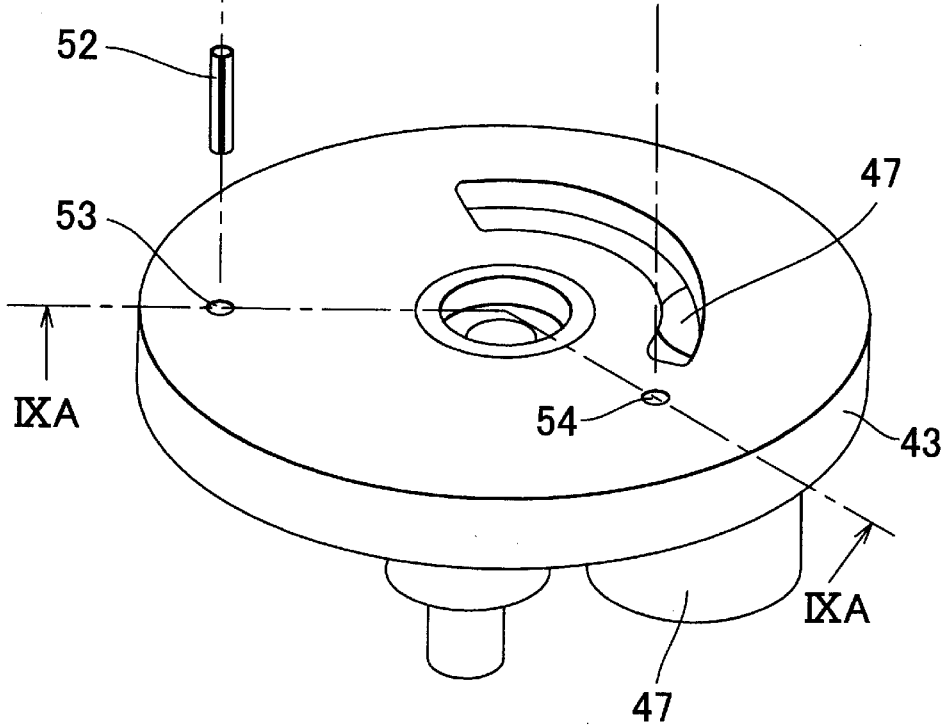
FIG. 9B RELATED ART
Figure 10A:
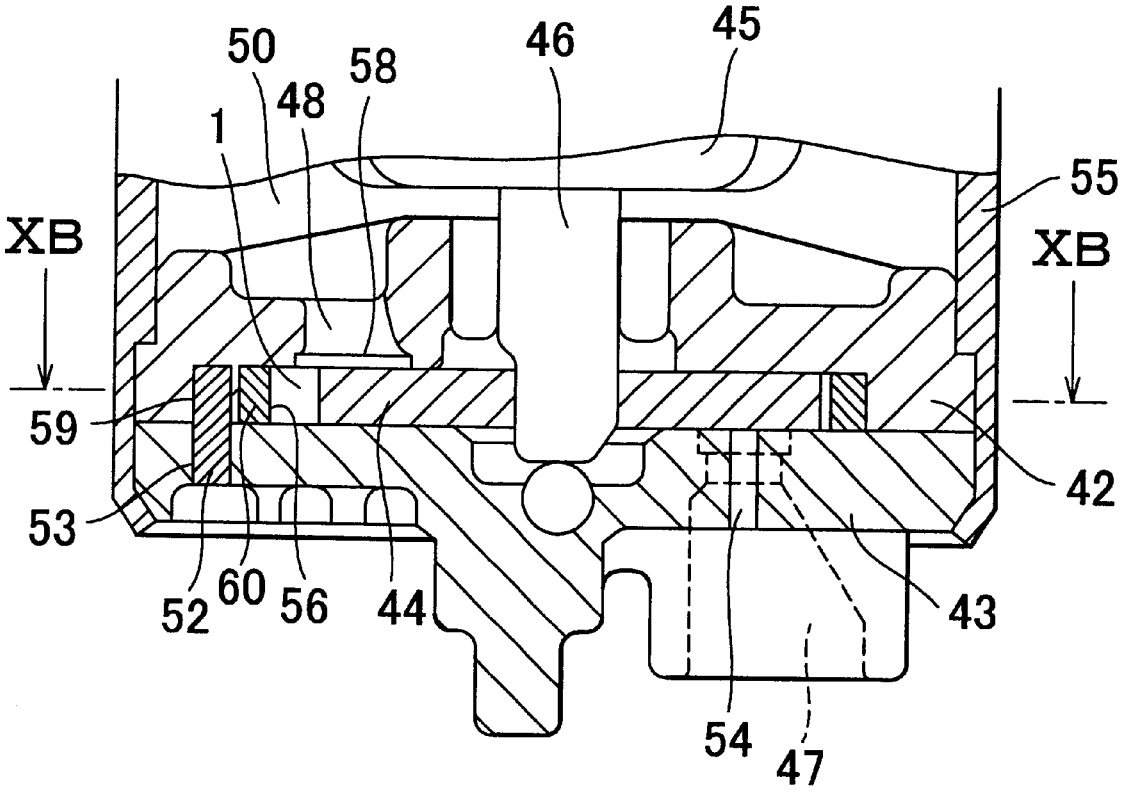
FIGS. 10A and 10B show the inside of a pump chamber of the same related art in detail.
Figure 10B:
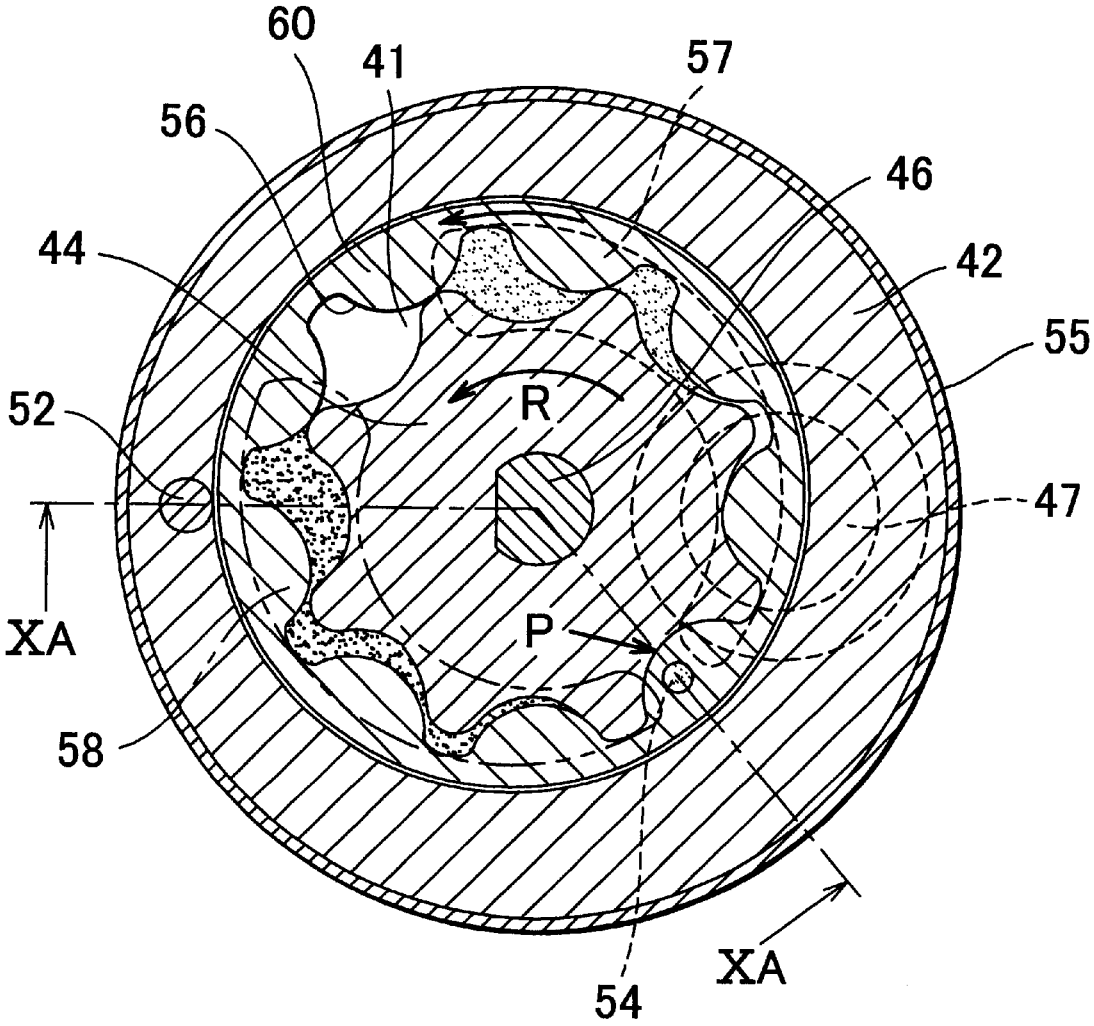
F I G. 10B RELATED ART

The entire structure of a pump apparatus according to the invention is the same as the structure shown in FIGS. 9A and 9B as mentioned above. A pump body portion is constituted by combining a housing 2 which rotatably accommodates an outer rotor 38 so as to form a pump chamber 1 on the inner peripheral surface with a cover 3 abutting against the lower surface of the housing 2 so as to cover the pump chamber 1. In the pump chamber 1 formed in the rotatable outer rotor 38, an inner rotor 44 is provided, of a trochoid gear or the like, as a pump member. The inner rotor 4 is rotated about a rotation axis 6 of a motor 5, whereby a fuel in a fuel tank is sucked through an intake port 7 formed on the cover 3. The sucked fuel is pressurized and discharged through a discharge hole 8 into a motor chamber 10. The pressurized fuel passing through the motor chamber 10 is, for example, as shown in FIG. 2, is supplied through a discharge hole 9 at an upper portion of the pump body to a fuel injection system or the like.

In the example of a fuel pump of FIG. 1, as shown in FIG. 1B, an internal teeth gear is formed on an inner peripheral surface 30 of the outer rotor 38 that is rotatably accommodated in the housing 2. Further, an inner rotor 4 is rotatably disposed inside of the outer rotor 38. An external teeth gear being capable of meshing with the internal teeth gear of the outer rotor 38 is formed on an external peripheral surface 30 of the inner rotor 4 in a manner like the trachoid gear. The external teeth of the inner rotor 4 have a small diameter and a smaller number of teeth than the above internal teeth of the outer rotor 38. This inner rotor 4 is rotated about the rotation axis 6 driven by the motor 5 as above and pump action is carried out.

At this time, in accordance with rotation of the outer rotor 38 and the inner rotor 4 in a direction shown in arrow R in the FIG. 1B, the fuel sucked through the intake port 7 is sucked via an intake groove 31 formed on the upper surface of the cover 3 into a pump chamber at an intake stroke side. Next, after the chamber at the intake stroke side is closed and the fuel is compressed, the chamber is communicated with a discharge groove 32 formed at a discharge port 8 side, and the fuel is discharged through the discharge port 8 into the inside of the motor body.

When the inner rotor 4 is rotated further, the external teeth of the inner rotor 4 mesh with the internal teeth on the inner periphery of the outer rotor 38 SO as to form a high-pressure closed chamber at portion P in FIG. 1B. In the aforementioned pump structure as shown in the FIGS. 8A and 8B and FIGS. 9A and 9B, a point-like pressure relief hole was provided in the vicinity of portion P. However, in the embodiment as shown in FIG. 1 in a boundary area portion between a high-pressure portion and a low-pressure portion, provided is a pressure relief groove 33 capable of covering the boundary area sufficiently. Further, the pressure relief groove 33 is provided with a pressure relief hole 34 for communicating it with outside of the fuel pump.

Figure 6A:
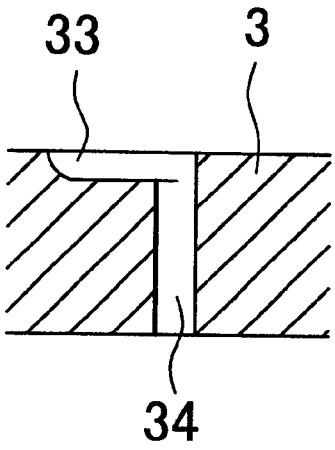
FIGS. 6A and 6B show an example when a pressure relief groove and a pressure relief hole is used for releasing high-pressure fuel to the outside.
Figure 6B:
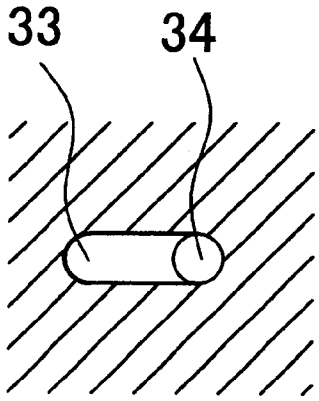

It is preferable that the aforementioned pressure relief groove 33 is provided so as to contain a portion shown by point P in the figure, that is a portion in which a closed chamber is formed by meshing of the external teeth of the inner rotor 4 with the internal teeth on the inner periphery of the outer rotor. A shape of the pressure relief groove 33 is not limited, as long as it extends to cover the portion P, and a form of various shapes and depths can be allowed. An enlarged view of the pressure relief groove that releases high-pressure fuel to the outside and the pressure relief hole portion provided on the pressure relief groove according to the aforementioned embodiment is shown in FIGS. 6A and 6B. Further, a position of the pressure relief hole can be selected to be any position in which machining work of this hole is easily performed.

By a structure like this, when the discharge stroke is completed by rotation of the inner rotor 4 and the high-pressure fuel is going to be closed in the closed chamber at point P portion in FIG. 1B, since the pressure relief groove 33 is provided at this portion and the pressure relief groove 33 is provided with the pressure relief hole 34 for communicating it with the fuel pump exterior portion, the aforementioned high-pressure fuel is released to the fuel pump exterior portion through the pressure relief groove 33 and the pressure relief hole 34. In particular, when this fuel pump is provided in the fuel tank, the fuel from the pressure relief hole 34 drips into the inside of the fuel tank, then the fuel is sucked into the fuel pump again and released.

Further, in the embodiment as shown in FIGS. 1A and 1B when assembling the housing 2 and the cover 3, in order to position the both, a positioning pin 12 is inserted into a pin insertion hole 11 formed on the cover 3, and a pin insertion hole 13 is formed at a position opposite to the positioning pin 12 in the housing 2. This is the same as the pump as shown in FIGS. 9A and 9B and FIGS. 10A and 10B.

Figure 7A:
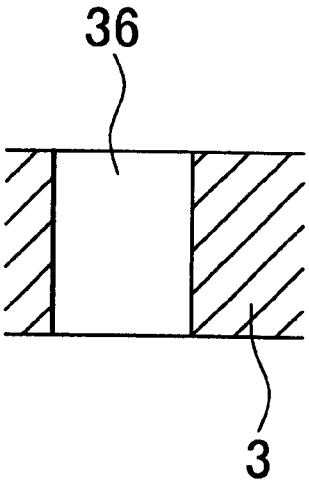
FIGS. 7A and 7B show an example when a slit is used to release high-pressure fuel to the outside.
Figure 7B:
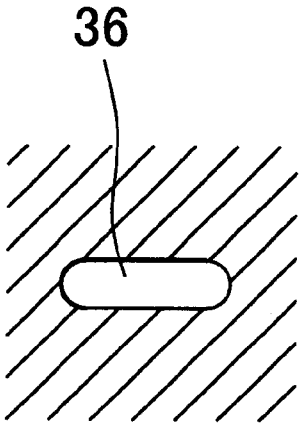

In the aforementioned embodiment, as means for releasing high-pressure fuel in the fuel pump to the outside of the fuel pump, an example in which the pressure relief hole and the pressure relief groove provided therein are provided is shown. Further, in another example as shown in FIGS. 7A and 7B, the aforementioned pressure relief groove may be a pressure relief slit 36. The upper portion of the pressure relief slit 36 corresponds to a portion where the aforementioned pressure relief groove is formed, and the lower portion thereof is communicated with the fuel pump exterior portion and opened. Accordingly, man-hours can be reduced than a case where the pressure relief groove and the pressure relief hole are provided as in the aforementioned embodiment, and a similar effect of pressure relief can be obtained.

Figure 3A:
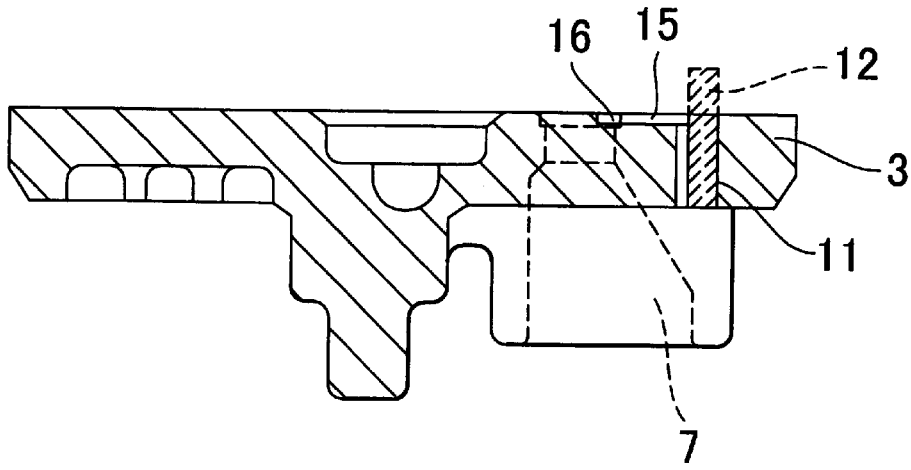
FIGS. 3A and 3B show a cover portion of the same embodiment.
Figure 3B:
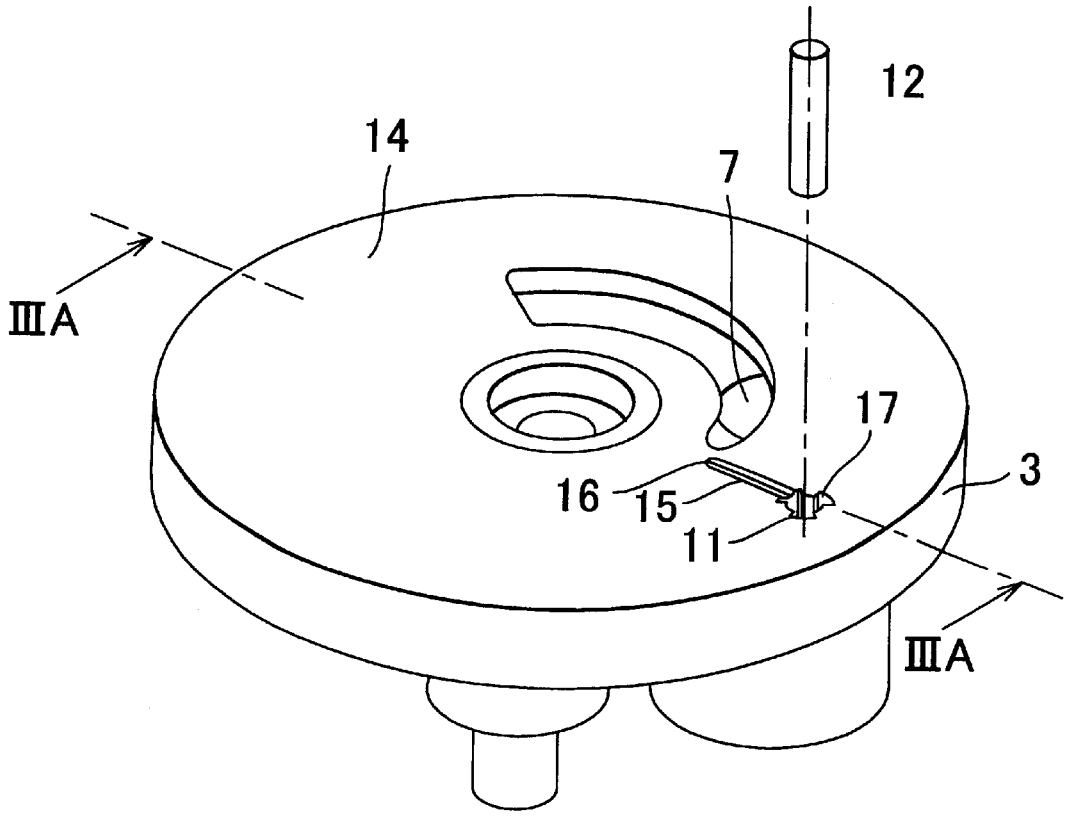
Figure 4A:
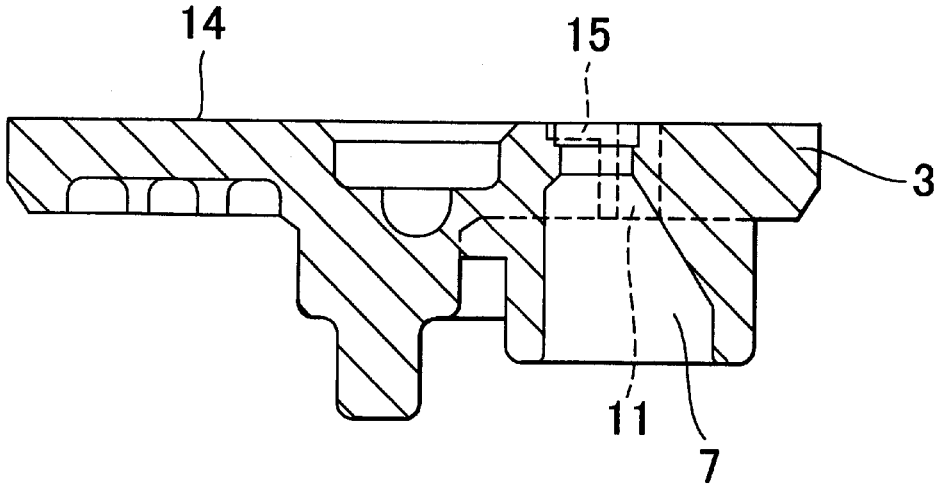
FIGS. 4A and 4B show the cover portion according to the same embodiment.
Figure 4B:
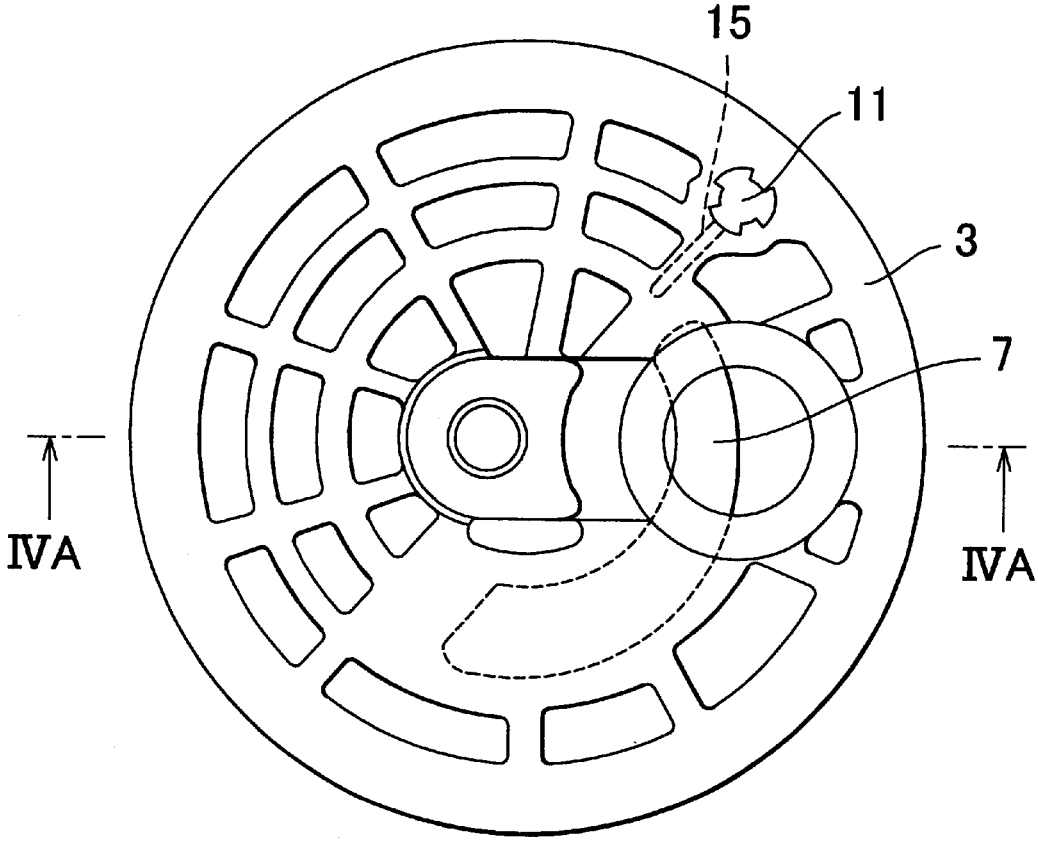
Figure 5A:
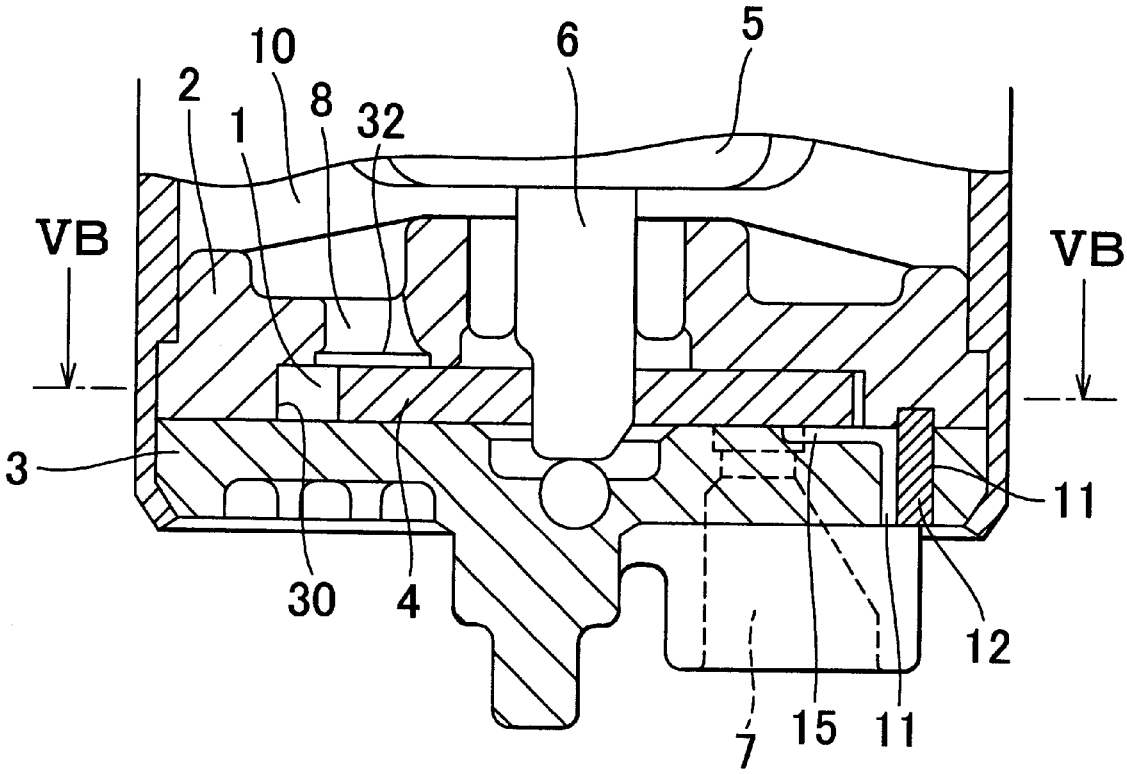
FIGS. 5A and 5B are a view showing the inside of a pump chamber in detail in the same embodiment.
Figure 5B:
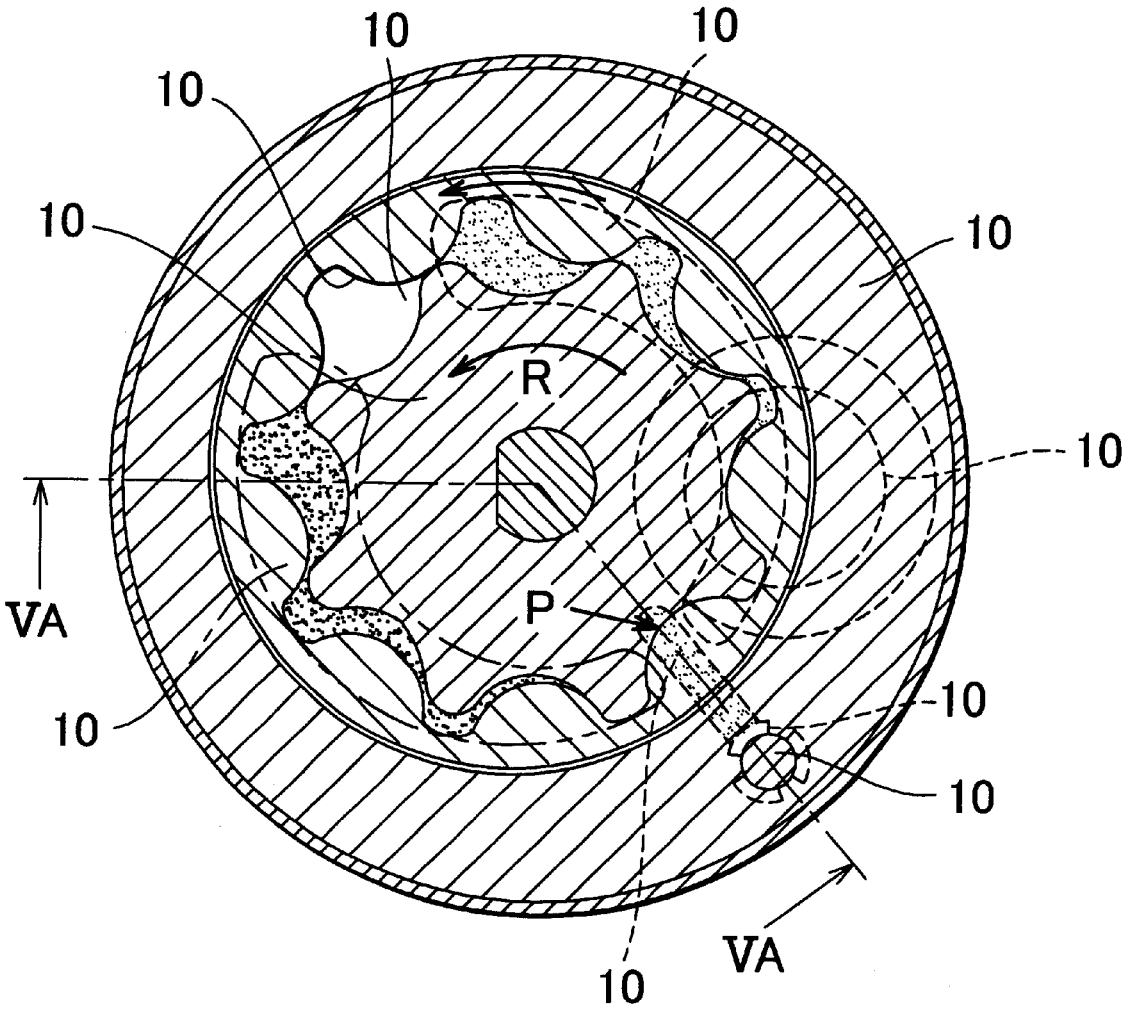

FIGS. 2, 3A, 3B, 4A and 4B show a fuel pump which achieves the aforementioned first object of the invention and eliminates the necessity of forming two holes, that is, the pressure relief hole and the positioning pin insertion hole. FIG. 2 showes the entire embodiment, with a cross section of a main portion. FIG. 3A is a sectional view of a portion along the pressure relief groove at the cover portion, in which characteristics of the invention is represented. FIG. 3B is a perspective view of the cover portion. Further, FIG. 4A is a sectional view of a portion including the intake port at the cover portion, and FIG. 4B is bottom view of the cover portion.

An example of the cover 3 shown in FIGS. 3A and 3B is such that a tip opening portion 16 of a pressure relief groove 15 is positioned, on an upper end surface 14 of the cover in which the pressure relief and pin insertion hole 11 is opened, at a position at which the pressure relief hole is formed or at a position sufficiently closer to the center in the fuel pump, as shown in FIGS. 9A and 9B and FIGS. 10A and 10B. The form of the pressure relief groove 15 is the same as that of the pressure relief groove 33 shown in FIGS. 1A and 1B. In particular, in this embodiment, the rear end portion of the pressure relief groove 15 is communicated with an opening portion 17 of the pressure relief and pin insertion hole 11 as above, allowing a part of fuel in the high-pressure portion in the pump chamber to be introduced to the pressure relief and pin insertion hole 11 through the pressure relief groove 15. Note that, though, in the aforementioned embodiment, the pressure relief groove is formed on the upper end surface of the cover 3, the structure is not limited to this. The pressure relief groove may be, for example, formed at the housing 2 side as shown in FIG. 1A. Namely, even though the pressure relief groove is provided on the lower end face of the housing opposite to the side face of the outer rotor 38 and the inner rotor 4, the same action as the aforementioned embodiment can be made.

Figure 8A:
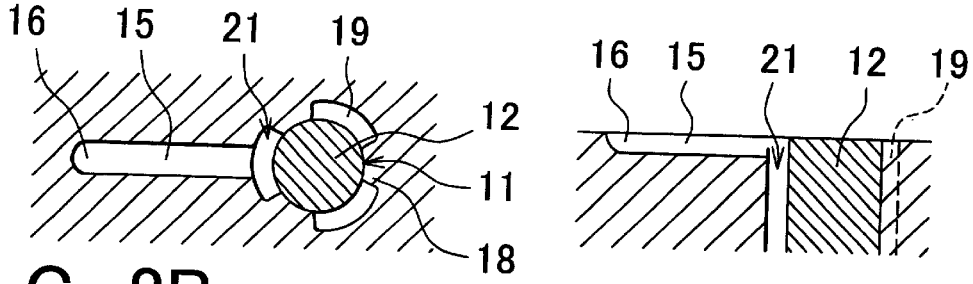
FIGS. 8A, 8B, 8C, 8D and 8E are sectional views showing various forms of a pressure relief and pin insertion hole and a pressure release portion, respectively, that are used in the invention.

The pressure relief and pin insertion hole 11 and the positioning pin 12 are formed of various forms and can be used in combined used. In the aforementioned embodiment, the pressure relief and pin insertion hole 11 is formed with a shape as shown in an enlarged view in FIG. 8A. Namely, in this embodiment, the cylindrical positioning pin 12 is used, and the external diameter of the pressure relief and pin insertion hole 11 is larger than that of the positioning pin 12*a*. Further, protrusion portions 18 protruding toward a center of the hole are formed at three points at an equal interval as shown in FIG. 8A, and a pin insertion support portion is formed on the inner surface of the protrusion portions 18. The cylindrical positioning pin 12 is inserted into the pin insertion support portion.

In this embodiment, when inserting the positioning pin 12 into the pin insertion support portion, three passages 19 are formed in the pressure relief and pin insertion hole 11, and at least one of them is communicated with the aforementioned pressure relief groove 15 to form a pressure relief passage 21. Therefor, the high-pressure portion in the pump chamber can be communicated with the pressure relief groove 15, and through to the pressure relief passage 21, and a high-pressure fuel can be released via the pressure relief passage 21 to the outside of the pump. Further, the pressure relief passage 21 is formed by the outer peripheral portion of the positioning pin 12 and the inner peripheral surface of the pressure relief and pin insertion hole 11 of the cover 3. In other words, the positioning pin 12 constitutes a part of the pressure relief and pin insertion hole 11, and the pressure relief passage 21 constitutes the rest of the pressure relief and pin insertion hole 11.

Thus, in the invention, it is not necessary to form two holes, that is, the positioning pin insertion hole into which the positioning pin is pressed and by which it is supported, and the pressure relief hole, as shown in FIGS. 9A and 9B and FIGS. 10A and 10B. Rather, it is proper to form a single pressure relief and pin insertion hole, reducing man-hours and providing inexpensive motor-type fuel pump for the vehicle. Further, the pressure relief groove 15 can functions as preventing high-pressure fuel from entering the intake side, same as the embodiment shown in the above FIGS. 1A and 1B.

Figure 8B:
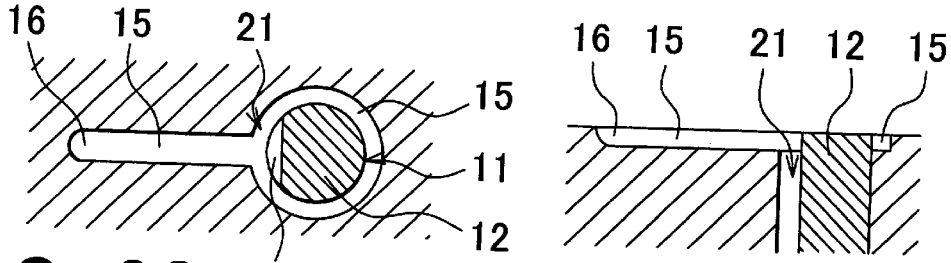

The pressure relief and pin insertion hole 11 and the positioning pin 12 may be provided in other forms than those shown in FIGS. 8B to 8E, the pressure relief and pin insertion hole 11 with a circular sectional shape, for example. In the insertion hole 11, as in the embodiment as shown in FIG. 8B, a notch 22 with a semicircular section with respect to the side surface and communicated with the pressure relief groove 15 so as to form the pressure relief passage 21. Since the pressure relief and pin insertion hole 11 are formed into a circular shape, the formation thereof is easy. Further, by forming the pressure relief groove 15 along the entire periphery of the pressure relief and pin insertion hole, positioning is not required when inserting the positioning pin 12, and assembly becomes easier.

Figure 8C:
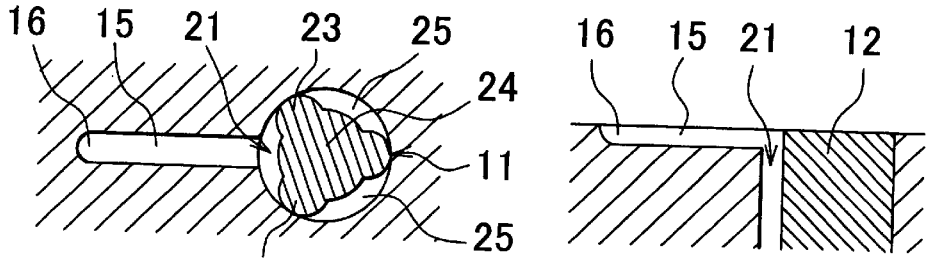

Further, as shown in FIG. 8C, a rod 24 formed with three protrusion portions 23 with a circular section around the periphery of the rod 24. At least one of three outer peripheral grooves 25 formed around the periphery of the rod 24 may be communicated with the pressure relief grooves 15, so as to form the pressure relief passage 21.

Figure 8D:
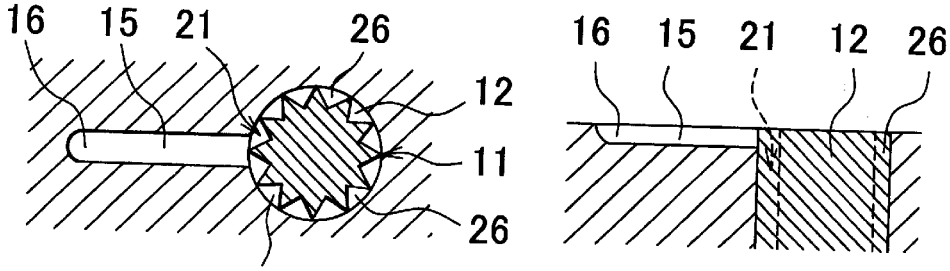

As another example, as shown in FIG. 8D, many V-shaped groove 26 extending axially are formed around the periphery, and one of the V-shaped groove 26 may be provided as the pressure relief passage 21. Forming of V-sharped groove 26 like these eliminates the necessity of positioning with respect to the pressure relief groove 15 when fixing the positioning pin.

Figure 8E:
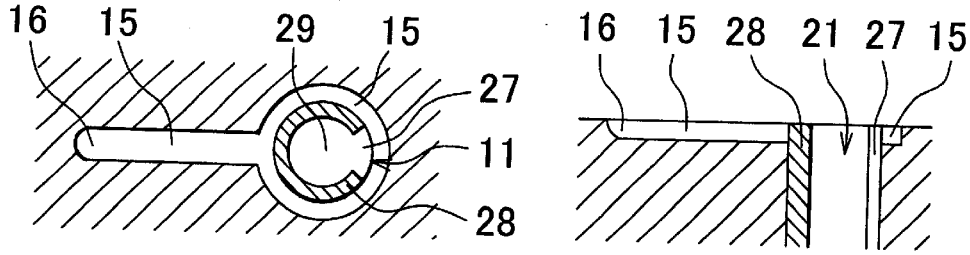

Further, as shown in FIG. 8E, a hollow cylindrical elastic positioning pin 28 with a C type in section may be inserted into the circular pressure relief groove 15. When inserting this elastic positioning pin 28 into the pressure relief groove 15, since the pin itself has elastic force, it can absorb a manufacturing error of the external diameter. Accordingly, manufacturing and assembling being made easily. Further, as explained with reference to FIG. 8B as above, the pressure relief groove 15 may be formed over the entire periphery of the pressure relief and pin insertion hole. Further, in each of the above embodiments, the pressure relief groove 15 may be a slit as shown in FIGS. 7A and 7B as above.

Other than those as shown in the figures, the aforementioned pressure relief and pin insertion hole 11 and the positioning pin 12 may be embodied in various forms. For example, used are the positioning pin 12 as shown in FIG. 8D for the pressure relief and pin insertion hole 11 having a cross section of a different diameter as shown in FIG. 8A, or an elastic positioning pin 28 or the like. Further, in the above embodiment, an example is shown in which the positioning pin 12 is fixed protruding to the housing in advance, when assembling, it is inserted into the pressure relief and pin insertion hole 11 provided on the cover 3. On the contrary, the positioning pin 12 may be press fitted and fixed into the pressure relief and pin insertion hole 11 provided on the cover 3, and when assembling, the positioning pin 12 may be inserted into a pin insertion hole at the housing 2 side.

Further, an example of the housing is shown in the above embodiment is one integrally formed by the side surface portion opposite to the cover with the fuel discharge hole formed therein and the housing body portion forming the pump chamber therein, and thus forming the pump chamber outer periphery. Alternatively, for example, a side face member provided with the fuel discharge hole, a housing body member which forms the pump chamber therein, and the pump chamber outer periphery are manufactured separately, and thus the housing may be made by combining these. In this case, when fixing the positioning pin to the housing side, the pin insertion hole may be formed such that the positioning pin pierces the side face member, and the pin insertion hole may be formed only in the housing member.

A motor-type fuel pump for a vehicle according to an embodiment of the invention is formed, at a boundary area portion between a high-pressure portion and a low-pressure portion of the pump, with a pressure relief chamber extending along the boundary area portion, and the above pressure relief groove is formed with a pressure relief hole for communicating it with outside of the fuel pump. Therefore, the fuel in the high-pressure portion in the pump can be introduced with reliability to the pressure relief groove before reaching the low-pressure portion, and released through the pressure relief hole formed so as to be communicated with this pressure relief groove to the outside. Accordingly, generation of vapor lock, which is caused by entry of high-pressure fuel at the discharge side of the pump chamber into an intake side, can be prevented with reliability.

Further, since the vehicle motor-type fuel pump is formed, at a boundary area portion between the high-pressure portion and the low-pressure portion of the pump, with a slit so extending the boundary area portion and the slit is opened to outside of the fuel pump, the same effect as the above can be obtained with small man-hours, only by forming the slit at a predetermined portion.

Further, the motor-type fuel pump for a vehicle positions a housing accommodating the pump therein and a cover provided with a fuel intake hole by means of a positioning pin, and the pressure relief hole is provided in the cover for releasing pressure from the pump chamber on the cover. Since the motor-type fuel pump is structured such that the positioning pin is inserted into the above pressure relief hole, and a pressure relief passage can be secured for the above pressure relief hole when inserting the positioning pin, it is not necessary to form two holes, that is, a hole, into which the positioning pin is inserted for assembling the housing and the cover, and a pressure relief hole for releasing the pressure in the pump chamber, and it is necessary to only form one hole. Therefore, man-hours are reduced and a motor-type fuel pump for a vehicle can be provided at low cost.

Further, the aforementioned pressure relief hole is communicated with a boundary area portion of the high-pressure portion and the low-pressure portion by means of the pressure relief groove extending along the boundary area portion. Therefore, it is possible to freely communicate, by means of the pressure relief groove, an opening portion at the pump chamber side of the pressure relief hole which is predetermined based on the operational characteristics of the pump, with an insertion hole of a positioning pin which is disposed at a position where the pin is unable to pass through the pump chamber and also serves as pressure relief hole. Therefore, degree of freedom in disposing, in particular, the pressure relief and pin insertion hole is enhanced.

Further, the pressure relief groove allows the fuel at the high-pressure portion in the fuel pump to be introduced to the groove with reliability before reaching the low-pressure portion, and to be released to the outside through the pressure relief hole communicated with and opened to the groove. Therefore, generation of vapor lock caused by entry of high-pressure fuel at the discharge side of the pump chamber into the intake side can be prevented with reliability. By optionally forming a pressure relief groove that carries out an action like this, degree of freedom in disposing the pressure relief and pin insertion hole is enhanced at the same time.

What is claimed is:

1. A motor-type fuel pump for a vehicle, comprising;

a housing accommodating a pump inside the housing; and a cover positioned with respect to the housing, wherein the cover provided with a fuel intake port, and a pressure relief hole into which a pin for positioning the cover to the housing is inserted, and which secures a passage for releasing pressure in the pump chamber in a state where the pin is being inserted.

2. A fuel pump according to claim 1, wherein;

the motor is provided with the rotary operation means comprises an inner rotor provided with external gear teeth and an outer rotor provided with internal gear teeth the number of which is larger than that of the external gear teeth, the inner rotor cooperating with the outer rotor to define therebetween a plurality of pressure chambers which are changed in accordance with the rotation of the inner and outer rotors, and wherein the cover serves to form side wall of the pressure chambers.

3. The fuel pump according to claim 2, wherein;

the pressure relief hole is formed in the side wall of the pressure chambers.

4. The fuel pump according to claim 1, further comprising:

a pressure relief groove extending along a boundary area between a high-pressure portion and a low-pressure portion inside of a pump chamber to communicate the boundary area in the pressure chamber with the pressure relief hole.

* * * * *